US006694655B2

(12) United States Patent
Redburn et al.

(10) Patent No.: US 6,694,655 B2
(45) Date of Patent: Feb. 24, 2004

(54) SECURITY IDENTIFICATION TAG

(76) Inventors: Loren Redburn, 23 Forest St., Weymouth, MA (US) 02190; Kenneth F. Florek, 8 Shadowbrook Dr., Colts Neck, NJ (US) 07722

( * ) Notice: Subject to any disclaimer, the term of this patent is extended or adjusted under 35 U.S.C. 154(b) by 0 days.

(21) Appl. No.: 10/123,454

(22) Filed: Apr. 15, 2002

(65) Prior Publication Data

US 2003/0192218 A1 Oct. 16, 2003

(51) Int. Cl.[7] ..... B09F 3/14; B09F 3/20
(52) U.S. Cl. ..... 40/664; 40/5; 70/68; 292/307 A
(58) Field of Search ..... 40/664, 665, 316, 40/630, 5; 70/68; 24/429; 292/307 A; 76/68

(56) References Cited

U.S. PATENT DOCUMENTS 972,971 A * 10/1910 Wood ..... 292/307 A
3,255,501 A * 6/1966 Laguerre ..... 24/16 PB

* cited by examiner

*Primary Examiner*—Cassandra H. Davis
(74) *Attorney, Agent, or Firm*—Philip E. Roux; Clifford Chance US LLP

(57) ABSTRACT

A security identification tag having an elongated body and a label, the elongated body including a leading end and a second end, an opening for receiving the leading end at a point between the leading end and the second end and an elongated aperture for receiving at least a portion of the label, the label having an area for receiving identification information.

13 Claims, 2 Drawing Sheets

SECURITY IDENTIFICATION TAG

FIELD OF THE INVENTION

The present invention relates to the field of identification tags and, more particularly, to the area of identification tags which cannot be removed without destruction or evidence of tampering.

BACKGROUND OF THE INVENTION

Identification tags come in many forms. These have included tags in the form of labels which are applied directly to an item by an adhesive and tags which can be hung on an item having an opening, such as a handle on a piece of luggage. Currently, "hang tag" type identification tags used on such items as luggage comprise a paper, plastic coated, plastic or tag made of another material which is attached by a string, chain or strap to the handle or other opening on a piece of luggage. However, these tags can be easily removed from the luggage and provide no security to the luggage, serving the sole function of identification.

It is therefore an object of the present invention to provide an identification tag which not only provides identification of an item but also provides security through the visual indication of removal or tampering.

SUMMARY OF THE INVENTION

These and other objects are achieved by the present invention, directed to an identification tag comprising an elongated body and a label, said elongated body comprising a leading end and a second end, an opening for receiving said leading end at a point between the leading end and the second end and an elongated aperture for receiving at least a portion of the label, said label being capable of receiving identification information.

In the preferred embodiment, at least a portion of the label is adapted to pass through the elongated aperture and adhere to itself about one of the walls of the elongated aperture. In this embodiment it is preferred that the label include a substantially permanent adhesive on at least a portion thereof, such that the label cannot be removed without some visual indication.

Most preferably, the label would have a first surface capable of receiving printed identification information and a second surface on which a self-stick adhesive is applied. This provides that once the label is passed through the elongated aperture, the adhesive surface can be folded onto itself to substantially permanently adhere the label to itself about a wall of the elongated aperture.

BRIEF DESCRIPTION OF THE DRAWINGS

The following drawings, in which like reference characters indicate like parts, are intended only to illustrate the preferred embodiments of the invention without limiting the invention in any manner whatsoever, wherein.

DETAILED DESCRIPTION OF THE PREFERRED EMBODIMENTS

Figure 1:
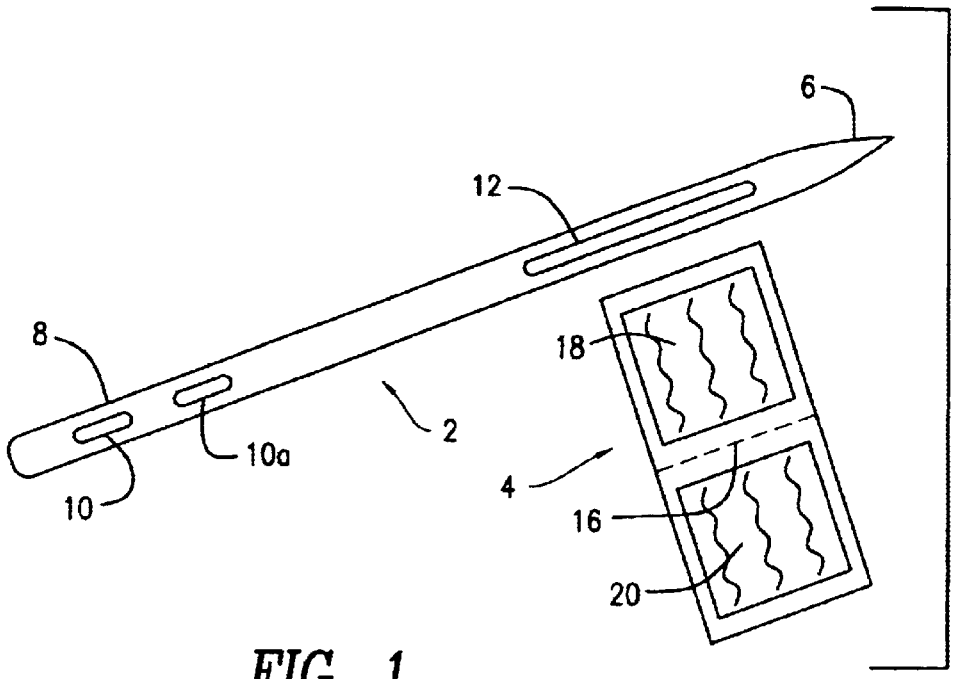
FIG. 1 is an exploded view of a first embodiment of the invention with both the body and the label in their open configurations.

As shown in the drawings, the present invention is directed to a security identification tag comprising an elongated body 2 and a label 4. The elongated body 2 comprises a leading end 6 and a second end 8 with at least one opening 10 through which the leading end 6 can pass, the at least one opening 10 being located at a point between the leading end 6 and the second end 8. The elongated body 2 further comprises an elongated aperture 12 for receiving at least a portion of the label 4, said label 4 being capable of receiving identification information.

The security identification tag of the present invention provides a secure identification wherein the device, once properly attached in its closed configuration, cannot be removed without the visual indication apparent to the person who filled out or otherwise marked the label 4. Thus, a tamper evident closure is created.

Figure 2:
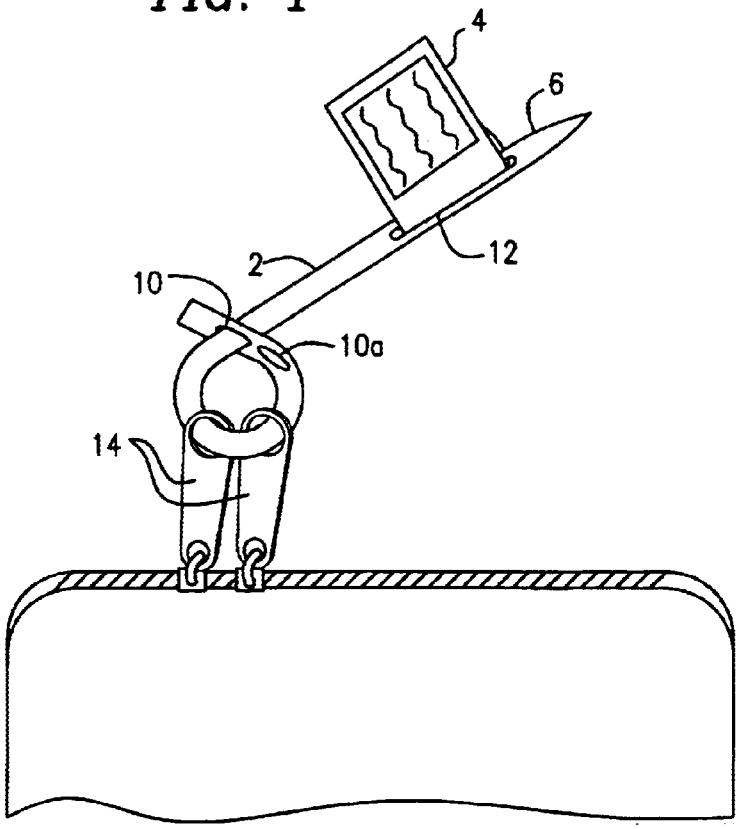
FIG. 2 is a perspective view of the embodiment of FIG. 1 in its closed configuration with the label attached, i.e., in its closed configuration.

In its most preferred embodiment, shown in FIGS. 1 and 2, the elongated body 2 has a plurality of openings 10 and 10*a* for receiving the leading end 6 of the elongated body 2. Additionally, the elongated aperture 12 is located in an area associated generally with the leading end 6 of the elongated body 2. In this embodiment, the plurality of openings 10 end 10*a* are located in an area associated with the second end 8 of the body 2.

Thus, when the leading end 6 of the elongated body 2 is passed through one of the openings 10 or 10*a*, the elongated aperture 12 also passes through the openings 10 or 10*a*, emerging through the other side to the opening 10 or 10*a* (see FIG. 2). Once the leading end 6 passes through the opening 10 or 10*a* the label 4 can be passed through the elongated aperture 12 and secured to ensure that it cannot be removed without detection.

In its preferred embodiment the label 4 is a self-stick adhesive label where the adhesive is a permanent adhesive. As such, once adhered, any effort to remove the label 4 will destroy the label 4. The label 4 has an area 18 for receiving identification information, preferably comprising a print-receiving surface.

The luggage owner marks the label 4 with their name and address in their own handwriting, or an airport personnel marks the label 4 with an official stamp. If the security tag is to be removed, either the label 4 must be torn off of the body 2 or the elongated body 2 must be cut off or broken, depending on the material. As such, a third party tampering with the identification tag will not be able to replace the device on the luggage with the user's handwritten name and address, known to the user, or the official stamp on the label 4.

More particularly, since the label 4 will be destroyed upon removal, a third party tampering with the device cannot return the label 4 with the owner's written information or official stamp onto the body 2. Similarly, if the body 2 is cut off, the once adhered label 4 cannot be opened and placed through the elongated aperture 12 of a new body 2.

The label 4 also preferably includes a crease 16 indicating where the label 4 is to be folded on itself, to properly position the label 4 for closure on itself. Thus, a label 4 can have adhesive on one entire side, covered by a release layer, and can be folded onto itself to ensure that it will be sealed. Alternatively, only a portion of the label 4 can have adhesive on it, as long as the permanent closure aspect is maintained.

In an alternative embodiment, the label 4 can be made of a non-tear material having a printable surface on one side and adhesive on the other. In such an embodiment, the label 4 is not torn off for removal of the identification tag, but the body 2 must be cut off for removal.

In the preferred embodiment, the plurality of openings 10, 10*a*, etc. allows the loop of the elongated body 2 to be smaller or larger. If the opening 10 is closer to the second end 8 is used the loop will be larger. If the opening 10*a* is used the loop can be made smaller.

Figure 3:
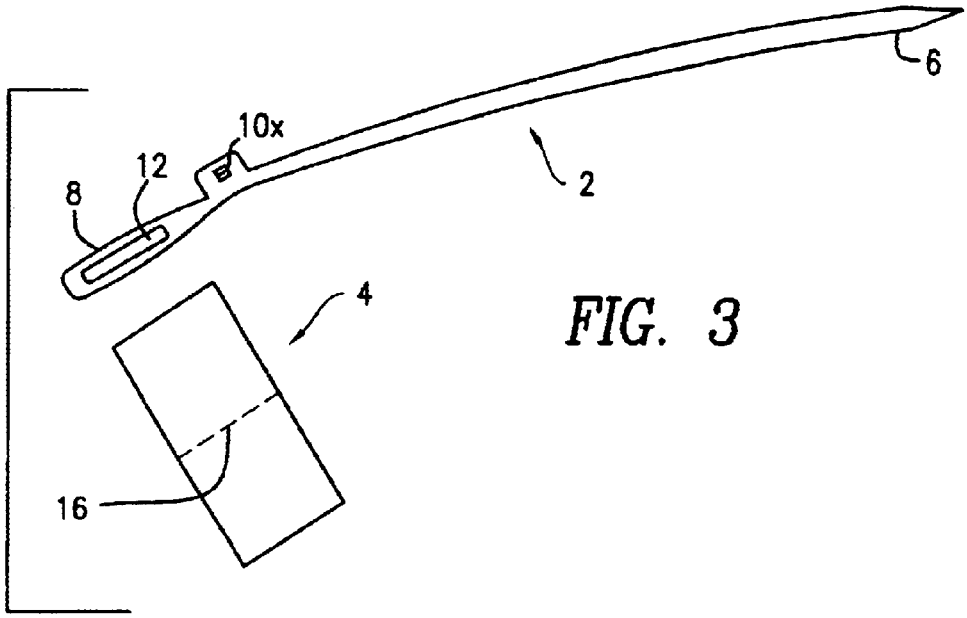
FIG. 3 is an exploded view of a second embodiment of the invention with both the body and the label in their open configurations.
Figure 4:
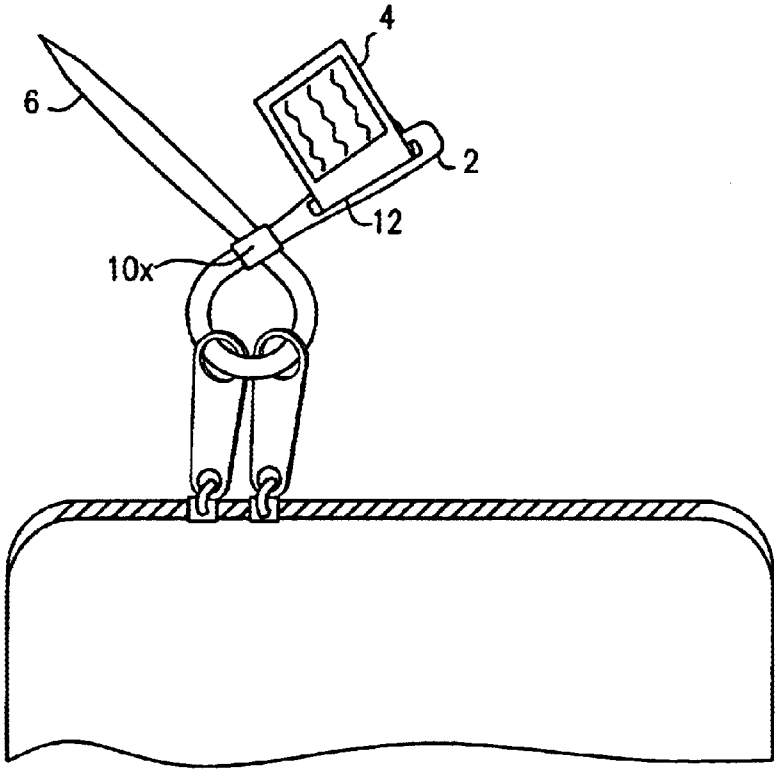
FIG. 4 is a perspective view of the embodiment of FIG. 3 with both the body and the label in their closed configuration, i.e., with both the body and the label secured.

In an alternative embodiment, shown in FIGS. 3 and 4, the elongated aperture 12 is located in an area associated with the second end 8 of the elongated body. In this embodiment, the opening 10*x* for receiving the leading end 6 is a one-way closure, as known in the prior art and seen on some prior art cable ties, wherein once the leading end 6 passes through the opening 10*x* it cannot be backed out. In this embodiment the loop can be made as small as desired but the body 2 will have to cut for removal of the tag. Notwithstanding, as above, the label 4 cannot then be removed and placed on a new body 2 without the user being able to detect tampering.

In any embodiment it is preferred that the leading end 6 of the body 2 is tapered for more easily treading the leading end 6 through the opening 10. All edges are preferably rounded and smooth for comfortable feel by the user. Specific colors for the body 2 or label 4 can also be used to provide further identification by a particular user.

The body 2 can be made of any suitable material, depending on the particular application. Preferably, the body 2 is made of a thermoplastic material, and most preferably a polyethylene when contemplated for general identification applications such as luggage tags on commercial airlines. If a stronger connection is desired, the body 2 can be made more durable such as with the use of an internal reinforcement, as is known in the cable tie art.

The use of a body 2 having an overall length of about 6–7 inches and an overall width of about ¼ inch is suitable for use of the present identification tag in the commercial travel industry.

It has also been found suitable for commercial travel purposes to have a label 4 of substantially consistent width, being about 1½ inches wide and about 5–6 inches long, for folding onto itself and adhered, providing a sufficient area 18 for printing information. Such a label 4 corresponds well with an elongated aperture 12 being about 1⅝ inches long.

The elongated aperture 12 is longer than it is wide to allow at least a portion of the label 4 to pass through. It has also been found that the elongated aperture 12 preferably have a width, i.e., having material removed from said width rather than being merely being a slit in the body, so that a label 4 with adhesive thereon does not readily catch on the sides of the elongated aperture 12.

The most preferred embodiment of the label 4 additionally includes an advertising area 20 where any venture can advertise its products, services or the like. For example, the commercial airline can print its logo in the advertising area 20 or the space can be sold to a company such as The Coca-Cola Company and imprinted with the trademark COCA-COLA® soft drink.

Where many passengers travel with luggage having zippered compartments, the identification tag of the present invention acts as a security device wherein the leading end 6 body 2 of the identification tag can thread through the zippers 14 and securely maintain the zippers 14 in a closed relationship. Of course, the identification tag of the present invention can also be used on single handles or other rings or openings on an article, but without providing the security aspect.

However, the security aspect of the identification tag of the present invention ensures that a third party will not be able to access the contents of a zippered compartment when out of the owner's control. Additionally, security officials such as airport personnel will be able to know that once an item was checked and secured, a third party has not placed items in the luggage.

Of course, changes, modifications and variations to the above obvious to those skilled in the art can be made without deviating from the present invention. All such changes, modifications, variations and the like are intended to fall within the spirit and scope of this present invention, limited only by the appended claims.

We claim:

1. An identification tag comprising an elongated body and a label, said elongated body comprising a leading end and a second end, an opening for receiving said leading end at a point between the leading end and the second end and an elongated aperture for receiving at least a portion of the label located between the leading end and the opening for receiving the leading end, said label comprising an area for receiving identification information and a self adhesive area, wherein at least a portion of the label passes through the slot of the elongated body and attaches to itself on said self adhesive area about one side of the elongated slot.

2. The identification tag of claim 1 wherein the label comprises a print-receiving surface in the area for receiving identification information.

3. The identification tag of claim 1 wherein the label comprises an advertising area.

4. The identification tag of claim 1 wherein the self-adhesive portion has a permanent adhesive associated therewith.

5. The identification tag of claim 1 wherein the elongated body comprises more than one opening for receiving said leading end spaced at different distances from the second end of the body.

6. The identification tag of claim 1 wherein the leading end of the body is tapered.

7. The identification tag of claim 1 wherein the body is made of a thermoplastic material.

8. The identification tag of claim 1 wherein the label has a substantially consistent width and the elongated aperture has a length corresponding to the width of the label.

9. The identification tag of claim 1 wherein the elongated aperture has a width, rather than a slit, with material removed from the area of the width.

10. An identification tag comprising an elongated body and a label, said elongated body comprising a leading end and a second end, an opening for receiving said leading end at a point between the leading end and the second end and an elongated aperture for receiving at least a portion of the label located between the second end and the opening for receiving the leading end, said label comprising an area for receiving identification information and a self adhesive area, wherein at least a portion of the label passes through the slot of the elongated body and attaches to itself on said self adhesive area about one side of the elongated slot.

11. The identification tag of claim 10 wherein the opening comprises a one-way opening so that once the leading end passes through it cannot be backed out.

12. The identification tag of claim 10 wherein the label has a substantially consistent width and the elongated aperture has a length corresponding to the width of the label.

13. The identification tag of claim 10 wherein the elongated aperture has a width, rather than a slit, with material removed from the area of the width.

* * * * *